US005188025A

United States Patent [19]

Murphy, III et al.

[11] Patent Number: 5,188,025

[45] Date of Patent: Feb. 23, 1993

[54] APPARATUS FOR CLEANING POSTAGE METER PRINTING INDICIA

[75] Inventors: Charles F. Murphy, III, Fairfield; William A. Salancy, Norwalk; Morton Silverberg, Westport; Steven A. Supron, Norwalk, all of Conn.

[73] Assignee: Pitney Bowes Inc., Stamford, Conn.

[21] Appl. No.: 812,548

[22] Filed: Dec. 23, 1991

[51] Int. Cl.[5] ..... B41L 47/46

[52] U.S. Cl. ..... 101/91; 101/425; 101/93

[58] Field of Search ..... 101/93, 423, 424, 425, 101/91; 15/256.5, 256.51

[56] References Cited

U.S. PATENT DOCUMENTS

| | | | |
|---|---|---|---|
| 975,883 | 11/1910 | McCoy | 101/425 |
| 1,043,812 | 11/1912 | Doyle | 101/425 |
| 1,864,340 | 6/1932 | Cunningham | 101/425 |
| 3,302,234 | 2/1967 | Moss et al. | 15/256.51 |
| 4,875,412 | 10/1989 | Wright et al. | 101/425 |
| 4,972,780 | 11/1990 | Gasparrini et al. | 101/425 X |

OTHER PUBLICATIONS

IBM Tech. Disclosure Bulletin, vol. 18, No. 8, Jan. 1976.

*Primary Examiner*—Edgar S. Burr
*Assistant Examiner*—Christopher A. Bennett
*Attorney, Agent, or Firm*—Charles G. Parks, Jr.; Melvin J. Scolnick

[57] ABSTRACT

A poster meter is insertable into and removable from a mail machine base receptacle. The postage meter includes a shutter bar which is slidably mounted to the meter. The shutter bar is positionable between a first position where the shutter bar is located opposite and blocking external access to the indicia plate of the meter and in a second position, the shutter bar is laterally positioned from said indicia plate. The receptacle is pivotally mounted to mailing machine base and includes a shutter bar locking mechanism for engaging the shutter bar in the shutter bar's first position and for slidably positioning the shutter bar between the first and second position. A brush assembly is mounted to the shutter bar for brushing or sweeping the indicia plate upon reciprocal displacement of the shutter bar between the first and second positions.

4 Claims, 6 Drawing Sheets

APPARATUS FOR CLEANING POSTAGE METER PRINTING INDICIA

BACKGROUND OF THE INVENTION

The present invention relates to electronic postage meters.

A new electronic postage meter and mailing machine combination is comprised of a mailing machine having a deck for receiving envelopes in a seriatim manner. The mailing machine includes a meter support structure for receiving a postage meter cartridge in proper alignment to allow a platen to strike a portion of the underside of an envelope positioned on the deck through a recess in the deck. The action of the platen causes the corresponding upper surface of the envelope to strike the print indicia of the postage meter. In order to ensure the proper indicia print quality after each indicia printing, an inking mechanism reinks the print indicia of the postage meter.

The postage meter indicia is comprised of an embossed plate having suitable apertures to allow the print element of a dater print wheel set and value set print wheels. In the specific postage meter addressed, it was considered advantageous to utilize a polymeric material over conventional ferrous materials in the composition of the indicia plate and the print elements of the dater and value print wheels. The indicia plate was constructed of 40 durometer rubber. During evaluation of the electronic postage meter and mailing machine combination, it has been discovered that the processing of certain types of envelopes, fibrous material collected onto the indicia plate. It has been observed that over time, the collection of fibrous material has subsequent deleterious effect on the quality of the printed postage indicia.

SUMMARY OF THE INVENTION

It is an object of the present invention to present an apparatus and method of removing the collection of fibrous material from the print indicia of postage meter and other similar printing apparatus.

The electronic meter in accordance with the present invention is a flat-bed letter press printing postage meter which is removable from the mailing machine and in which there are included novel die protection features to protect the die when the meter is removed and the platen remains with the mailing machine or base. In order to prevent the fraudulent "stamping" of prints. The meter will not actually print, it will allow the prints to be taken by the mailing machine during a narrow time "window" when all of the mete die protection is withdrawn. In order to protect the printing indicia or die, there is included as a component part of the meter, a sliding plate which completely covers the printing elements when the meter is removed from the mailing machine. This plate cannot be retracted unless the meter is in place in a legitimate mailing machine.

A legitimate mailing machine includes a mechanism, which upon placement of the postage meter in a receiving receptacle interlock, engages with the protection plate and under the influence of a drive system housed in the mailing machine, repositions the protection plate to permit access to the print indicia. The mailing machine and postage meter include respective programmable microcomputer, which upon proper placement of the postage meter in a legitimate mailing machine, communicate to enable the drive system to reposition the protection plate to its stored position.

The protection plate has been adapted to carry a brush assembly. The microcomputer of mailing machine has now been programmed to cause the drive system to cause the protection plate to reciprocate between a home position subsequent to a selectable number on printed impressions. By so doing, any collection of fibrous material collected on the print indicia may be dislodged and deposited on the brush member.

DETAILED DESCRIPTION OF THE PREFERRED EMBODIMENT

Figure 1:
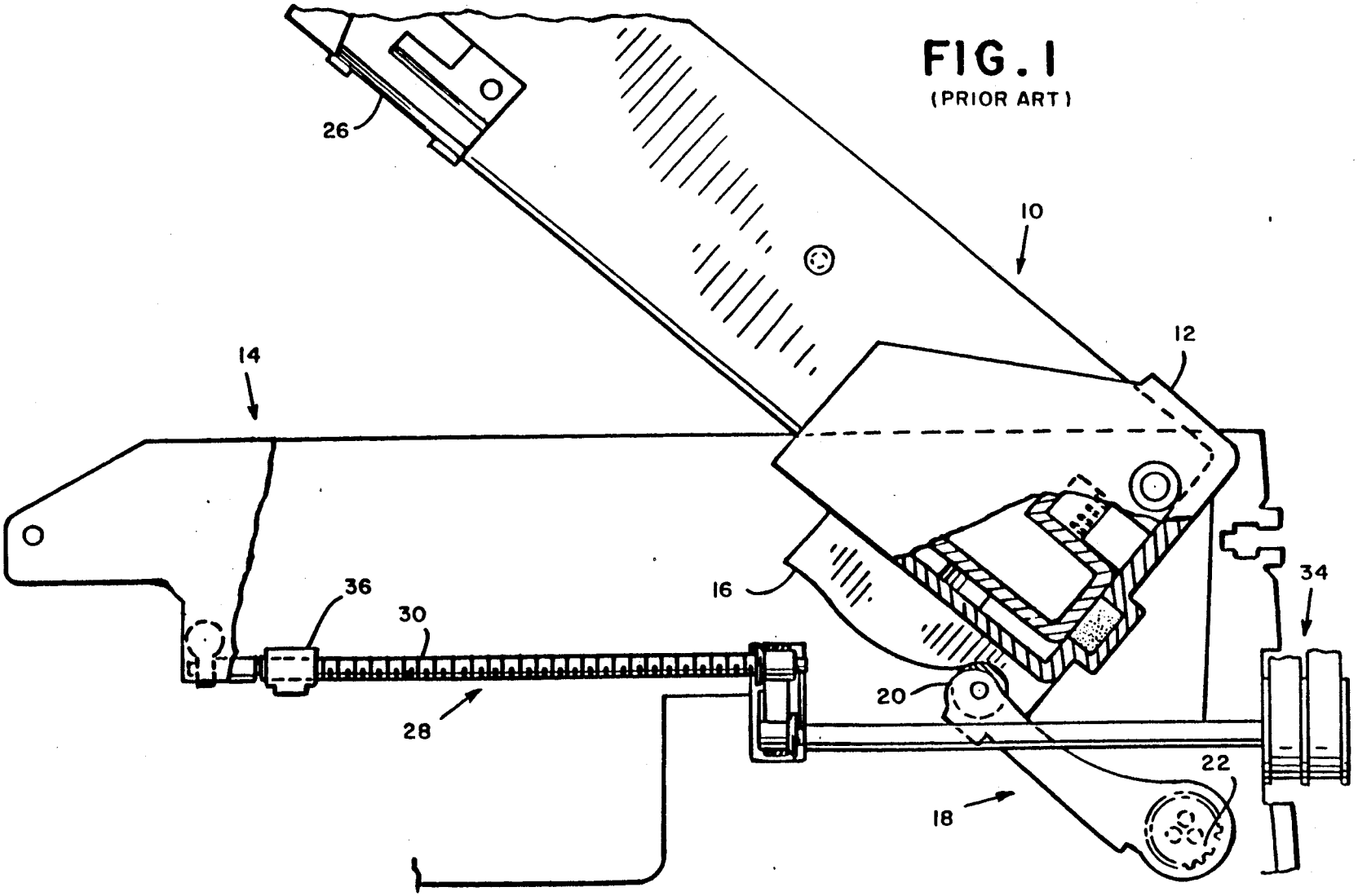
FIG. 1 (PRIOR ART)
FIG. 1 is a side sectioned view of a prior art meter cartridge and meter cartridge lock assembly.
Figure 2:
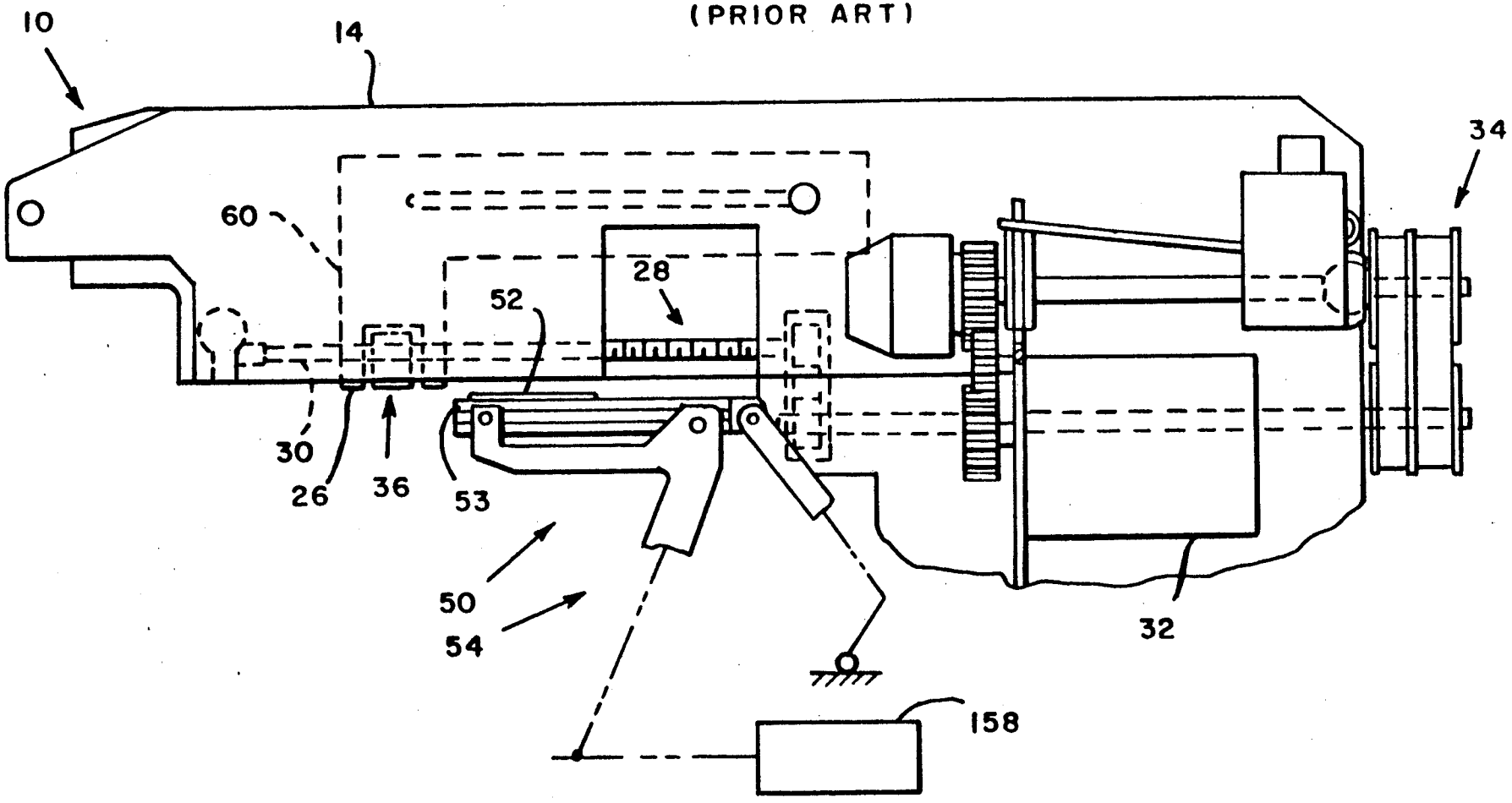
FIG. 2 (PRIOR ART)
FIG. 2 is a side section view of a prior art meter cartridge positioned within a mailing machine support structure.

Referring to FIGS. 1 and 2, a mail processing system has been developed employing an insertable postage meter cartridge into a mailing machine base as particularly described in U.S. patent application Ser. No. 07/607,322 (C-693) and U.S. Pat. No. 4,935,078, herein incorporated by reference.

Briefly here described, the postage meter cartridge 10 is insertable into a receiving meter pocket 12 which is pivotally mounted between support brackets 14 located within the mailing machine. The meter pocket 12 has a cam surface 16. A cam assembly 18 includes cam follower wheel 20 pivotally mounted to suitable torsion assembly 22 for causing the cam follower wheel 20 to ride along the cam surface 16 such that in a first position the meter pocket 12 is biased in a first position to receive the meter cartridge 10 and in a meter lock position to apply limited load on the cam surface 16.

The meter cartridge 10 includes a meter shutter bar 26 which is locked in place over the print area of the meter cartridge 10 when the meter cartridge 10 is removed from the mailing system. When the meter cartridge 10 is inserted into the mailing machine between the brackets 14, the shutter bar 26 is brought into engaging communication with the meter lock mechanism, generally indicated as 28. Briefly, the locking mechanism 28 is comprised of a threaded shaft 30 rotatively mounted to respective support brackets 14. The threaded shaft 30 is driven by a motor 32 through a drive train 34. Each threaded shaft 30 threadably carries an interlock pin 36 which is aligned to interlock with the shutter bar 26 when meter cartridge 10 is positioned between the brackets 14. Upon activation of the motor 32, the shafts 30 are caused to rotate and thereby translate the meter shutter bar 26 to a home position exposing the print indicia of the postage meter cartridge 10.

Also mounted within the mailing machine is a meter inking module 50. The meter inking module 50 includes an ink pad 52 carried within an ink tray 53 and ink pad transport structure, generally indicated as 54. Briefly, the ink pad transport structure 54 positions the ink pad 52 from a home position tucked below a rearwardly of the postage meter cartridge 10 print indicia to an intermediate position directly below the print indicia of postage meter cartridge 10. Thereafter, the transport structure 54 causes the ink pad 52 to vertically displace, bringing the ink pad 52 into contact with the print indicia of the postage meter cartridge 10 for the purpose of reinking the print indicia for printing. The transport structure 54 then causes the ink pad to be returned to the home position.

Figure 3:
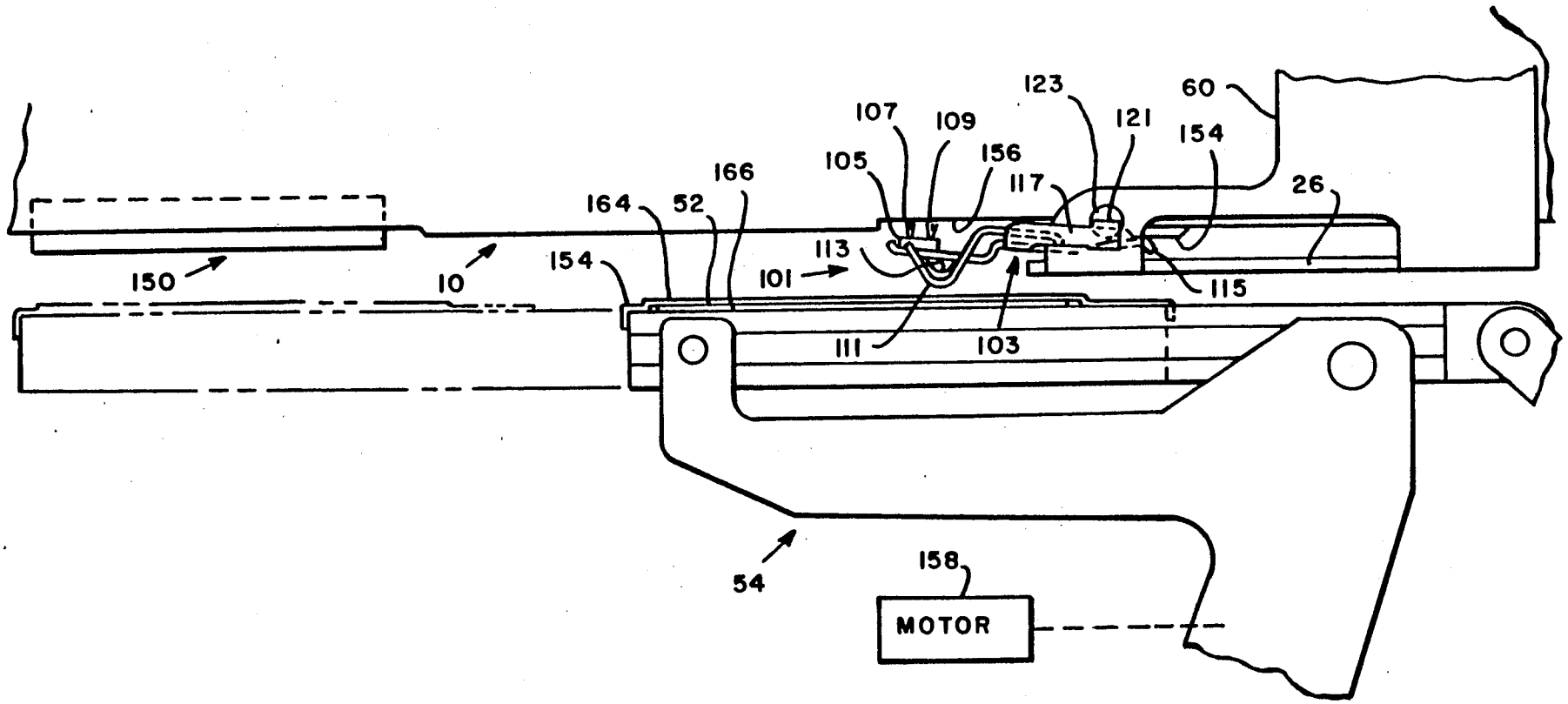
FIG. 3 is a partial side section view of the meter cartridge having a brush assembly in accordance with the present invention.
Figure 4:
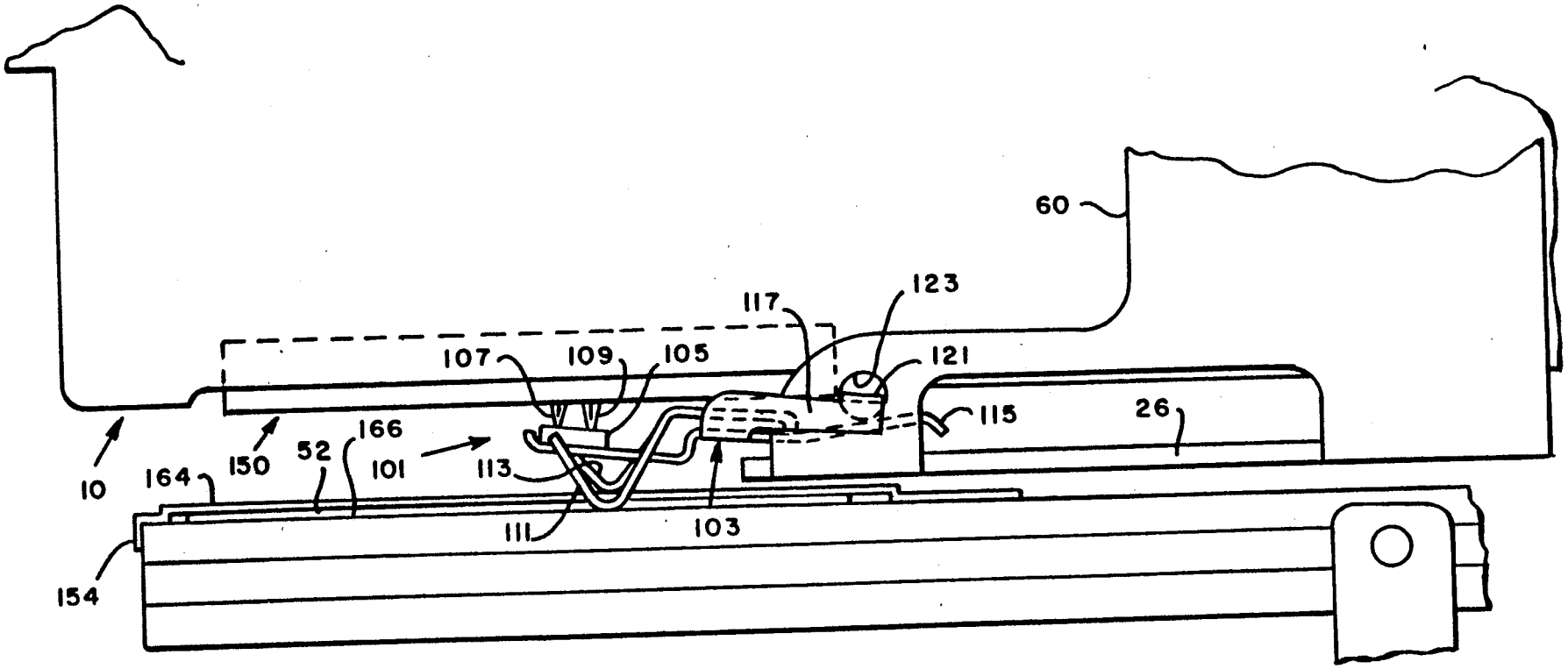
FIG. 4 is a partial side section view of the meter cartridge having the brush assembly positioned in a mid-sweep position in accordance with the present invention.
Figure 5:
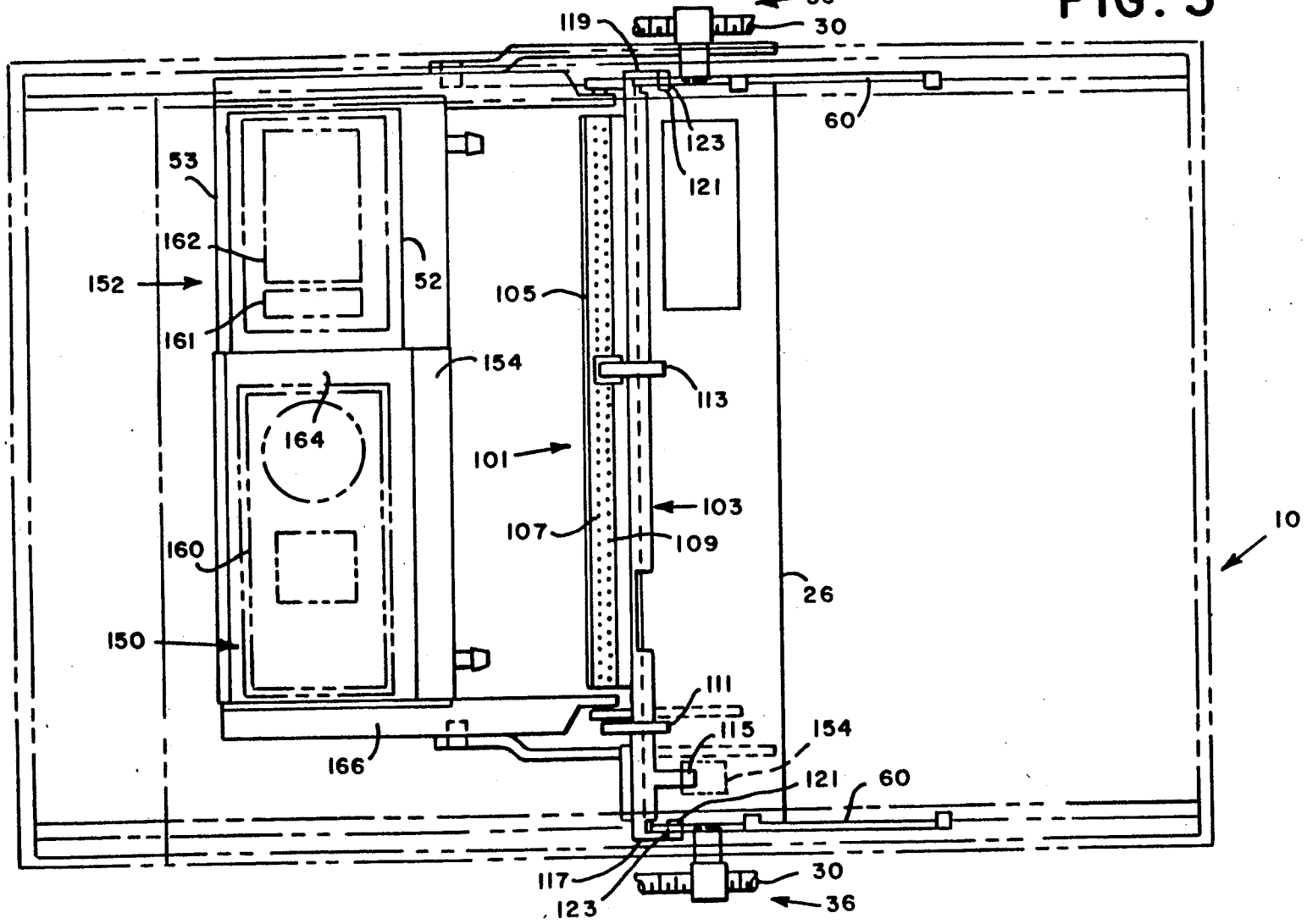
FIG. 5 is a top sectioned view of the brush assembly and inking assembly in accordance with the present invention.

Referring now more particularly to FIGS. 3, 4, and 5, the shutter bar 26 side arms 60 have been modified to pivotally support a brush assembly 101. The brush assembly 101 includes a base 103. The base 103 has fixably mounted to a forward position, a brush 105 having two rows of bristles 107 and 109, respectively. Formed on the base 103 is a first leafed spring 111 and a second leafed spring 113. Also, formed on the base 103 is a pivot tab 115. The base 103 additionally has formed end arms 117 and 119, respectively. Each end arm 117 and 199, respectively, has a formed pivot tab 121. The pivot tabs 121 are pivotally received in apertures 123 in respective shutter bar support arms 60.

Referring first to FIG. 3, the postage meter cartridge 10 is illustrated in the meter locked operational position having the meter indicia plate 150 exposed for printing and the inking system, generally indicated as 152, in its home position (refer to FIG. 5). It is noted that the pivot tab 115 of the brush assembly 101 is abutting to a deflection notch 154 formed on the postage meter cartridge 10 causing the brush assembly 101 to pivot the brush 105 into a channel 156 also formed in the postage meter cartridge 10. To initiate an indicia sweep, the inking system 54 positioning motor 158 causes the inking system 54 to position its ink tray 53 to the intermediate position (illustrated in phantom in FIG. 3 and best seen in FIG. 5) which position is aligned below the indicia plate 150 (illustrated in phantom in FIG. 5).

Referring more particularly to FIGS. 4 and 5, the meter lock mechanism 28 is actuated by motor 32 causing the shutter bar 26 to be reciprocally displaced between its home position to a first position and, in so doing, causing the brush assembly 101 to be reciprocally displaced across the postage meter indicia 150. To ensure sweeping contact between the brush assembly brushes 107 and 109, the ink tray 53 includes a frame structure 154 which covers a portion of the ink pad 52 in a manner as not to interfere with reinking of the postage meter indicia 150. In the most preferred embodiment of the present invention, the postage meter indicia is comprised of three spaced sections 160, 161 and 162, respectively, illustrated in phantom in FIG. 5. The first section 160 is a posting indicia and the second section 160 is a mail class indicia. The third section 162 is provided for an ad slogan indicia.

During reciprocal displacement of the brush assembly 101, the leafed spring 113 is caused to ride on a surface 164 of the frame structure 154 and the leafed spring 111 is caused to ride on surface 166 of the ink tray 53 in such a manner that the brush assembly 101 is biased into communication with the postage meter indicia 150. It is now appreciated that the motion of the brush assembly sweeps the indicia of excess ink build-up around the indicia print elements.

Figure 6:
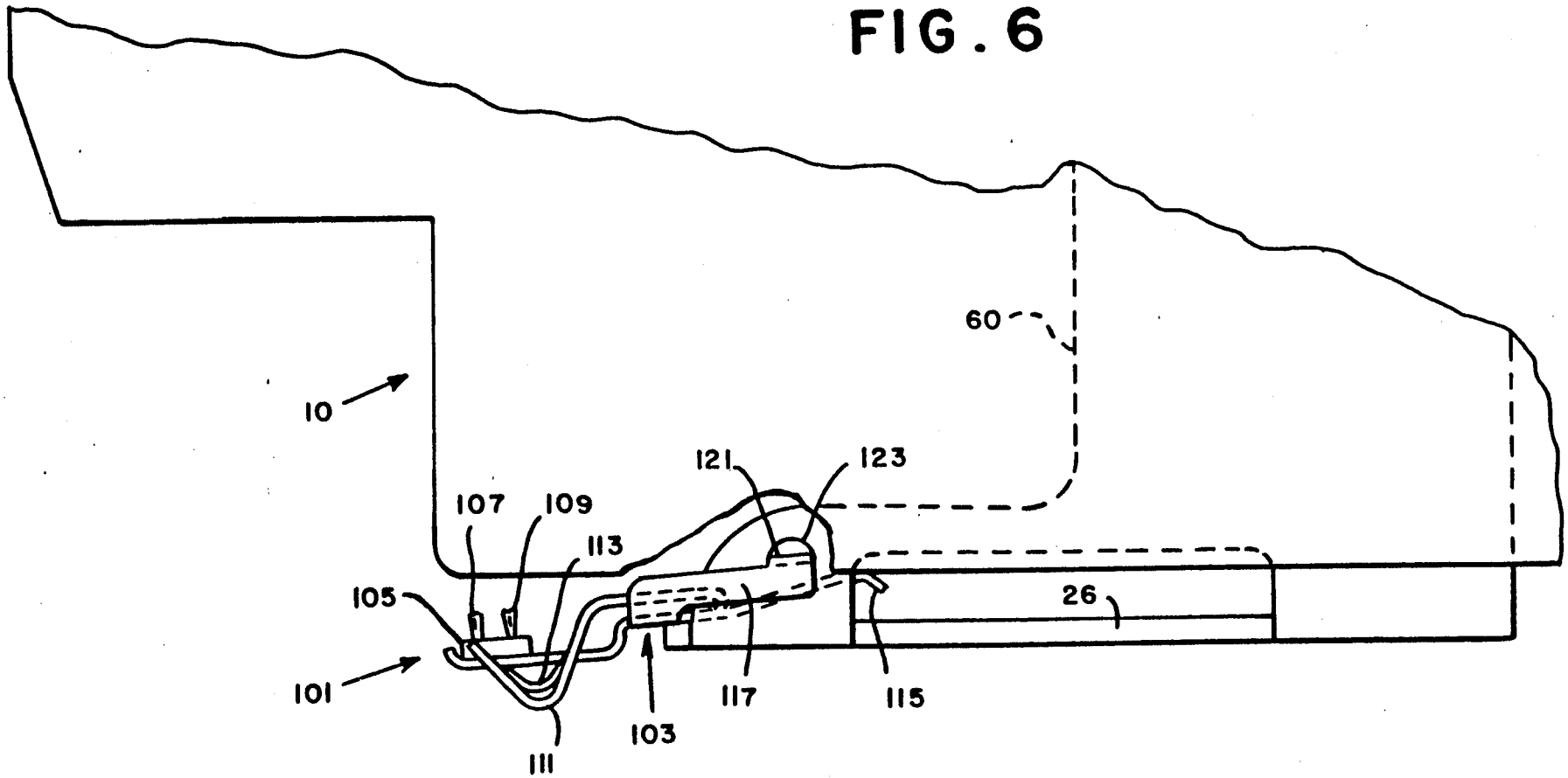
FIG. 6 is a partial side section view of the meter cartridge including the brush assembly in a meter transport position in accordance with the present invention.

Referring briefly to FIG. 6 for the purpose of completeness, the brush assembly 101 is illustrated in the meter 10 transport position, i.e , the meter 10 is removed from the mailing machine. In the meter 10 transport position, the shutter bar 26 is positioned over the meter 10 indicia and the brush assembly 101 is positioned forward thereof.

What is claimed is:

1. An improved combination of a postage meter insertable into and removable from a receptacle, said postage meter having a shutter bar slidably mounted to said meter such that in a first position said shutter bar is located opposite and blocking external access to an indicia plate of said meter and in a second position said shutter bar is laterally positioned from said indicia plate, said receptacle being mounted in a base and having a shutter bar locking mechanism for engaging said indicia plate in said shutter bar's first position and for slidably positioning said shutter ar between the first and the second position, wherein said improvement comprises:

a brush assembly having an elongated base pivotally mounted to said shutter bar, said base having a brush having a plurality of bristles mounted longitudinally therealong, said brush being fixably mounted to said base such that the bristles extend in the vertical direction of said indicia plate, and, biasing means for biasing said bristles into sweeping communication with said indicia plate when said shutter bar is reciprocally displaced between its first and second positions by said shutter bar locking mechanism.

2. An improved combination as claimed in claim 1, wherein said combination further comprises:

an indicia reinking means mounted to said base for reinking said indicia plate, said reinking means having an ink tray carrying an ink pad therein and position means for positioning said ink tray between a first position below said meter and laterally removed from said meter indicia plate to a second position vertically opposite and spaced apart from said indicia plate such that said shutter bar and carrying brush assembly may be positioned therebetween, and a third position wherein said ink pad is brought into contact with said indicia plate, said ink tray having at least one traversing surface extending over said ink pad, and, said base of said brush assembly having formed thereon at least one leafed spring, said at least one leafed spring being positioned to ride across said at least one transversing surface when said ink tray is positioned in said second position to cause said bristles of said brush to be biased into sweeping communication with said indicia plate upon reciprocal displacement of said shutter bar.

3. An improved combination of a postage meter insertable into and removable from a receptacle, said postage meter having a shutter bar slidably mounted to said meter such that in a first position said shutter bar is located opposite and blocking external access to an indicia plate of said meter and in a second position said shutter bar is laterally positioned from said indicia plate to allow indicia plate access, said receptacle being mounted in a base and having a shutter bar locking mechanism for engaging said indicia plate in said shutter bar's first position and for slidably positioning said shutter bar between the first and a second position, wherein said improvement comprises:

a brush assembly having an elongated base pivotally mounted to said shutter bar, said base having a brush having a plurality of bristles mounted longitudinally therealong, said brush being fixably mounted to said base such that said bristles extend in the vertical direction of said indicia plate, and, an indicia reinking means mounted to said base for reinking said indicia plate, said reinking means having an ink tray carrying an ink pad therein and position means for positioning said ink tray between a first position below said meter and laterally removed from said meter indicia plate to a second position vertically opposite and spaced apart from said indicia plate such that said shutter bar and brush assembly may be positioned therebetween, and a third position wherein said ink pad is brought into contact with said indicia plate, said ink tray having at least one traversing surface extending over said ink pad, and, said base of said brush assembly having formed thereon at least one leafed spring, said at least one leafed spring being positioned to ride across said at least one traversing surface when said ink tray is positioned in said second position to cause said bristles of said brush to be biased into sweeping communication with said indicia plate upon reciprocal displacement of said shutter bar.

4. An improved combination as claimed in claim 3 further comprising:

said meter having channel and ramp, said brush assembly having a formed pivot tab positioned to encounter said ramp when said shutter bar is in said first position and causes said brush assembly to pivot said brush into said channel.

* * * * *